US005247276A

United States Patent [19]

Yamazaki

[11] Patent Number: 5,247,276

[45] Date of Patent: Sep. 21, 1993

[54] PTC DEVICE

[75] Inventor: Naoki Yamazaki, Tokyo, Japan

[73] Assignee: Daito Communication Apparatus Co., Ltd., Tokyo, Japan

[21] Appl. No.: 690,005

[22] Filed: Apr. 23, 1991

[30] Foreign Application Priority Data

Apr. 25, 1990 [JP] Japan ..... 2-109226

[51] Int. Cl.[5] ..... H01C 7/10

[52] U.S. Cl. ..... 338/22 R; 338/22 SD

[58] Field of Search ..... 338/22 R, 22 SD, 28; 429/42

[56] References Cited

U.S. PATENT DOCUMENTS 3,432,355 3/1969 Niedrach et al. ..... 429/42

4,053,864 10/1977 Rodriguez et al. ..... 338/22 SD 4,241,289 12/1980 Bowling ..... 338/22 R X

*Primary Examiner*—Marvin M. Lateef

*Attorney, Agent, or Firm*—Thomas R. Morrison

[57] ABSTRACT

A self-recovery PTC device for overcurrent protection of electrical circuits is made with a polymer/metal powder composition electrode that displays stable resistivity over a broad range of contact forces. Secure bonding of electrodes to a PTC element is achieved because both components are polymer composites, eliminating the problems associated with attempts to bond metal electrodes to a polymer PTC element. Swelling of metal electrodes, that results from outgassing by a PTC element, is also eliminated, because polymer electrodes are gas permeable.

16 Claims, 4 Drawing Sheets

PTC DEVICE

BACKGROUND OF THE INVENTION

The present invention relates to a PTC (Positive Temperature Coefficient) thermistor element and more particularly to a PTC element used to protect against electrical circuit overcurrent surges.

Conventional PTC elements used to protect an electrical circuit use polymer dispersed carbonaceous conductive particles for PTC properties and a metal electrode affixed to the polymer. Polyethylene is conventionally used for the polymer component. Electrical stability is difficult to attain with these PTC elements, however, because the difficulty of joining or attaching the metal electrode to the polyethylene with sufficient bonding strength makes the resulting bond unpredictable. A second major drawback of these PTC elements is their tendency to peel during repeated use. This peeling is due to a difference in the coefficients of thermal expansion between the metal and polyethylene.

A further problem with PTC elements of the prior art is the fact that polyethylene is slightly permeable to gases, and the metal electrodes are impermeable. Thus, gases attempting to escape the polyethylene may collect under the metal electrodes, and encourage degradation of the bond.

Many methods for overcoming these problems have been used. For example, Japanese Patent Laid-Open No. 38162/1982 discloses a method wherein the surface of an electrode is treated with a titanate coupling agent where it is joined to the PTC element. The electrode is then bonded to the PTC element by thermal compression.

For another example, Japanese Patent Laid-Open No. 196901/1985 discloses a polymeric PTC thermistor wherein, prior to bonding, a surface of an electrode is roughened at the point where it joins the PTC element. The roughened surface contributes to mechanical keying, and thus improves the bond.

In yet another example, Japanese Patent Laid-Open No. 229679/1987 discloses a resistor composed of resin and conductive particles whose electrode is one of the following:

a low resistance compound produced by blending conductive particles in the same resin as the resistor, or in a resin capable of thermal fusion with the resistor;

a metal or carbon fiber coated with the low resistant compound.

Further, Japanese Patent Laid-Open No. 265401/1988 discloses a polymeric PTC thermistor using carbon fiber or activated carbon fiber as its electrode.

However, attaching a metal leaf electrode firmly to a conventional polyethylene PTC element remains problematic, and attaining electrical stability remains uncertain.

PTC elements that use metal electrodes have still another drawback. The electrodes of these PTC elements tend to peel during and after a thermal shock.

A metal electrode presents yet another problem. During cross-linking by gamma ray irradiation after attachment to a PTC element, an electrode may trap decomposition gas from the PTC element. This tends to destroy the bond.

Japanese Patent Laid-Open No. 229679/1987 discloses a PTC element, that consists of carbonaceous conductive particles and a polyethylene polymer. This PTC element is used with an organic electrode consisting of the same resin and conductive particles as the PTC element. This approach yields sufficient adhesion, but the use of similar resins for both the PTC element and the electrode causes other problems.

The resin composition of the PTC element is designed to open or trip at a predetermined temperature to protect an electronic circuit. Because the electrodes are formed of the same PTC composition as the PTC element, they are subject to thermal deterioration as they rise in temperature. As a result, these electrodes can fail at temperatures lower than the designed tripping temperature of the PTC element.

Because carbonaceous conductive particles are used for the organic electrode, the electrical resistance of the electrodes is high relative to a metal electrode. A commonly used conductive carbon black is Ketjen black. Although Ketjen black has a volume resistivity of about 1 ohm.cm, at a minimum, the volume resistivity of the electrode is considerably higher than this value. If the ratio of carbon black in the electrode is increased to a significant degree in an attempt to reduce the volume resistivity of the electrode, the composition of the electrode is weakened to the point where it is no longer usable.

Another problem with organic electrodes is that they cannot be attached to metal holders. This is not a problem with, for example, metal electrodes.

Yet another problem is that a polymer having a low affinity with the crystalline polymer used in the PTC element cannot be used for an organic electrode.

OBJECTS AND SUMMARY OF THE INVENTION

Accordingly, it is an object of the present invention to provide a PTC element for the protection of an electrical circuit that overcomes the drawbacks of the present art.

It is a further object of the present invention to provide a self-recovery PTC element with increased physical adhesiveness between a PTC element and an electrode.

It is a still further object of the invention to provide a self-recovery PTC element that, using an organic electrode, yields sufficient electrical stability and greater physical durability than a conventional organic electrode.

Briefly stated, the present invention provides a self-recovery PTC element for overcurrent protection of electrical circuits that is made with a polymer/metal powder composition electrode that displays stable resistivity over a broad range of contact forces. Secure bonding of electrodes to a PTC element is achieved because both components are polymer composites, eliminating the problems associated with attempts to bond metal electrodes to a polymer PTC element. Swelling of metal electrodes, that results from outgassing by a PTC element, is also eliminated, because polymer electrodes are gas permeable.

According to an embodiment of the invention, the present invention provides a PTC element comprising: a PTC element formed of a PTC composition, at least two electrodes formed of an electrode composition, the electrode composition being a polymer containing metal particles, and at least two electrodes being integrally affixed to the PTC element.

According to a feature of the invention, there is provided a PTC element comprising: a PTC element formed of a PTC composition, at least two electrodes formed of an electrode composition, the electrode composition being a polymer containing metal particles, the at least two electrodes being integrally formed with the PTC element, the electrode composition being a polyolefin derivative graft-polymerized with a monomer having a functional group onto the backbone of the polymer, and the PTC composition and the electrode composition are cross-linked.

According to a further feature of the invention, there is provided a PTC element comprising: a PTC element formed of a PTC composition, at least two electrodes formed of an electrode composition, the electrode composition being a polymer containing metal particles, the at least two electrodes being integrally formed with the PTC element, the electrode composition has a higher melting point than the PTC composition, and a volume resistivity of the at least two electrodes is less than about $4.0\times10^{-1}$ ohm.cm.

According to a still further feature of the invention, there is provided a method for making a PTC element comprising: mixing together a carbon black and a first polymer to produce a PTC composition, the carbon black and the first polymer being of a type providing a PTC characteristic, forming the PTC composition into a PTC element, cross-linking the first polymer in the PTC element, mixing together a metal powder and a second polymer to produce an electrode composition, and molding the electrode composition to the PTC element.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
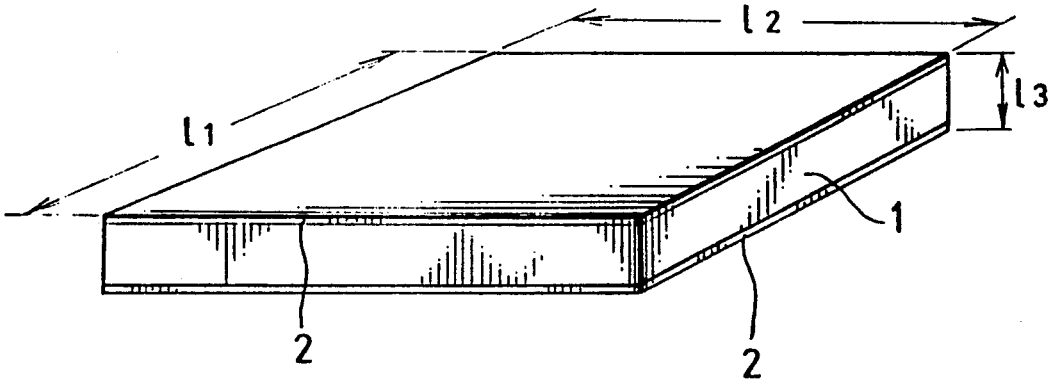
FIG. 1 is a perspective view of a PTC device according to an embodiment of the present invention.

Referring to FIG. 1, a PTC device 10 is a flattened parallelepiped comprising a PTC element 1 sandwiched between two electrodes 2.

PTC device 10 is made by compression molding electrodes 2 onto the broad surfaces of a preformed PTC element 1. The electrode composition is produced by blending and kneading a mixture of ingredients listed in Table 1 using a mixing roll for 30 minutes at 200° C.

PTC element 1 is made of ingredients listed in Table 2 and cross-linked by 60 Mrad of gamma irradiation prior to the molding on electrodes 2. In addition to gamma radiation, cross-linking may be accomplished by other means such as, for example, heat and chemical treatment. Chemical treatment may be, for example, the addition of an organic peroxide to the mixture. The techniques for cross-linking may be used in combination, without departing from the spirit and scope of the invention.

TABLE 1

| Electrode Composition | | | | | | |
|---|---|---|---|---|---|---|
| | | | conductive particles | | | |
| | polymer admar*1 | | metal powder | | carbonaceous conductive particles | |
| sample No. | grade | weight ratio | kind | weight ratio | kind | weight ratio |
| A | QF551 | 100 | Ni*2 | 400 | — | — |
| B | QF551 | 100 | Ni | 500 | — | — |
| C | QF551 | 100 | Ni | 600 | — | — |
| D | QF551 | 100 | Ni | 700 | — | — |
| E | QB540 | 100 | Ni | 600 | — | — |
| F | QF550 | 100 | Ni | 600 | — | — |
| G | QF550 | 100 | Ni | 600 | CB*4 | 30 |
| H | QF551 | 100 | Cu*3 | 600 | — | — |

*1Manufactured by Mitsui Petrochemical Industries
Adhesive polyolefine
QF551: Melting point - 135° C.
QF550: Melting point - 165° C.
QB540: Melting point - 150° C.
*2Manufactured by Fukuda Metal Foil & Powder Co., Ltd.
INCO Type 287 Nickel Powder
*3Manufactured by Fukuda Metal Foil & Powder Co., Ltd.
Cu—S (3L3)
*4Manufactured by Cabot Corporation
BLACKPEARLS 2000
Specific surface area: 1475 ($m^2/g$)
Average particle diameter: 15 nm

TABLE 2

| Composition of PTC Element | | | |
|---|---|---|---|
| name of material | grade | manufacturer | weight ratio |
| high density polyethylene* | Hi-Zex 1300J | Mitsui petrochemical industries | 100 |
| porous black** | asahiPB#400 | Asahi carbon | 32 |
| alumina | A32 | Nippon light metal | 81 |
| dicumylperoxide | percumyl D-40 | Nippon oil & fats | 0.8 |

*Melting point: 131° C.
**Produced from carbon black by increasing its specific surface area by vapor etching. It is less dependent on temperature when in actual use and maintains excellent PTC characteristics.

Figure 2:
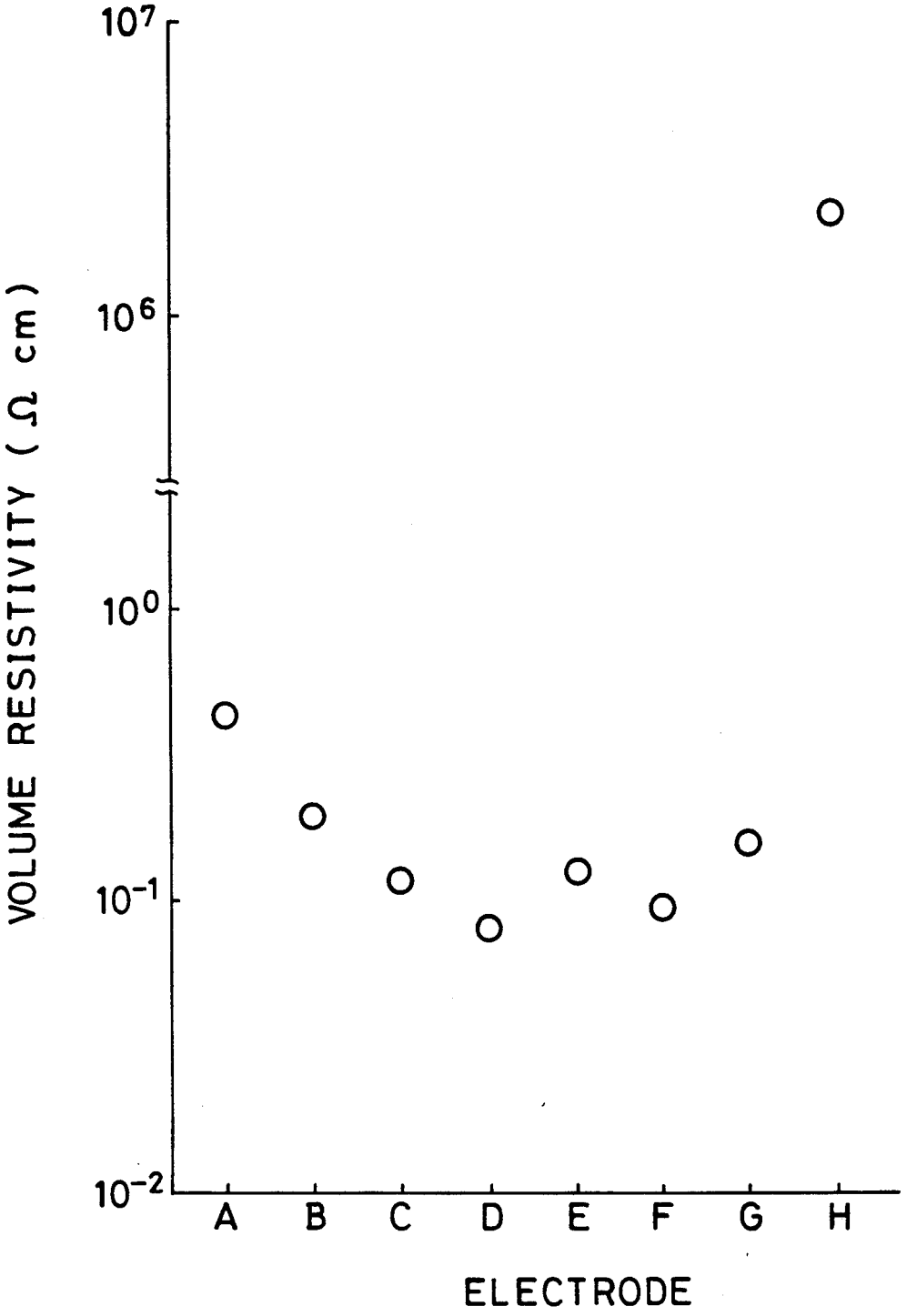
FIG. 2 is a plot of the volume resistivity of an electrode with reference to Table 1.
Figure 3:
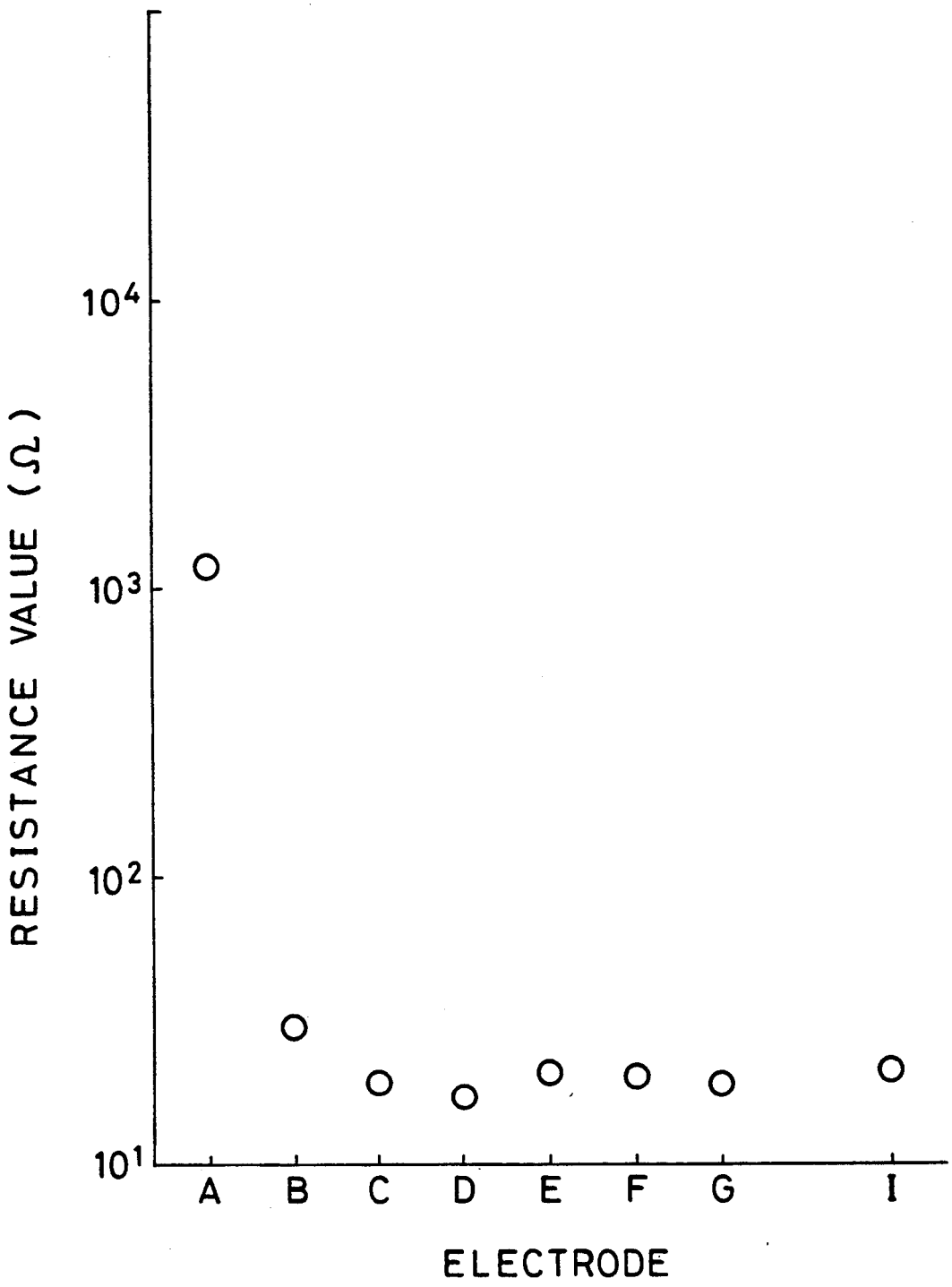
FIG. 3 is a plot of the resistance value of a PTC device with a PTC element composed with reference to Table 2 and electrodes composed with reference to Table 1.

Typical dimensions for a PTC device 10 of FIG. 1 are as follows: 11=13 mm, 12=13 mm and 13=2 mm. The volume resistivity of electrodes 2, shown in FIG. 2, and respective resistance values of PTC element 1 and a comparison example I, shown in FIG. 3, were obtained in a first embodiment test. Table 3 summarizes the results shown in FIGS. 2 and 3. In FIGS. 2 and 3 the letter entries (A-I) along the horizontal axis correspond to letter designators A through I of Tables 1 and 3.

Figure 4:
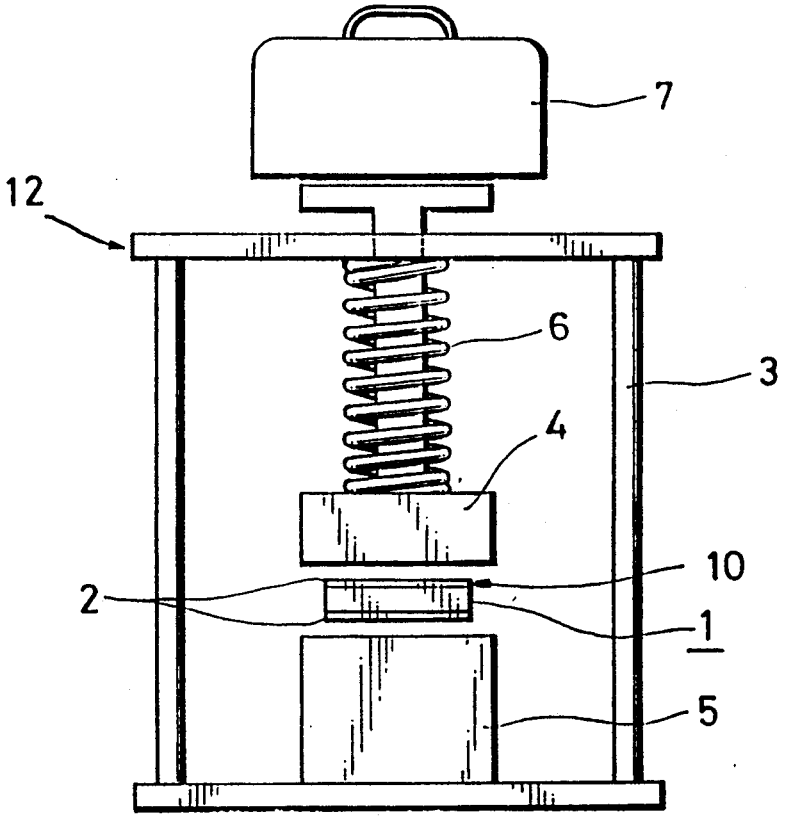
FIG. 4 is a front view of a PTC device in a holding fixture.

Referring to FIG. 4, a fixture 12 is used to measure the resistance value of PTC device 10. A frame 3 supports an upper holder 4 and a lower holder 5 in vertical opposition. A spring 6 is biased between frame 3 and upper holder 4 to provide a constant contact force of, for example, 800 gms between upper holder 4 and lower holder 5 and electrodes 2 of PTC device 10. Upper holder 4 and lower holder 5 each have a metal terminal (not shown) for providing low-resistance connection to electrodes 2.

The resistance of PTC device 10 is measured across the metal terminals of upper holder 4 and lower holder 5 by passing a current therebetween and measuring the voltage drop across PTC device 10.

Spring 6 may be replaced by a weight 7 applying force on upper holder 4 by gravity. It is contemplated that only one of these is used.

TABLE 3

| Element Resistance | | |
|---|---|---|
| sample No. | electrode volume resistivity ρ(Ωcm) | PTC element resistance value (Ω) |
| A | $4.25 \times 10^{-1}$ | 1200 |
| B | $1.96 \times 10^{-1}$ | 29.9 |
| C | $1.19 \times 10^{-1}$ | 19.3 |
| D | $8.09 \times 10^{-2}$ | 17.2 |
| E | $1.26 \times 10^{-1}$ | 21.2 |
| F | $9.46 \times 10^{-2}$ | 20.6 |
| G | $1.58 \times 10^{-1}$ | 19.3 |
| H | $2.30 \times 10^{6}$ | — |
| I | electrolytic nickel foil | 21.8 |

Sample H of Table 1, using copper powder for its conductive particles, shows a large increase in volume resistivity. This is due to active oxidization on the surface of copper powder in the blended mixture. Therefore, copper powder should not be used alone. Treatment to retard surface corrosion resistance is necessary when copper powder is used.

Figure 5:
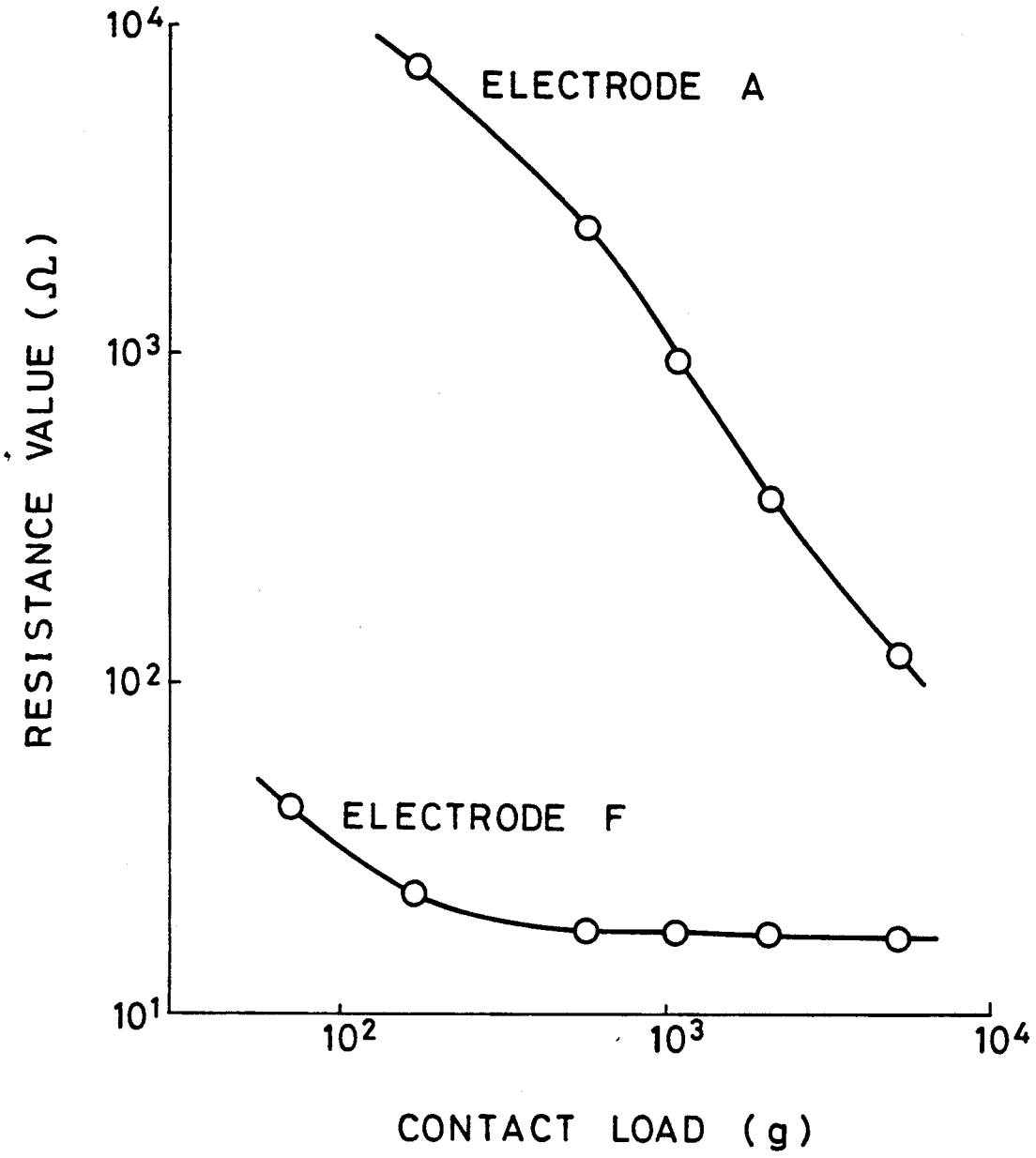
FIG. 5 is a curve showing the relationship between resistance value and contact load for two electrodes.

In a second embodiment, electrodes 2 were produced in the same manner as for the first embodiment. These electrodes 2 were made using ingredients A and F of Table 1. PTC element 1 was made using the PTC composition given in Table 2 that is previously cross-linked by 60 Mrad of gamma irradiation. These PTC devices 10 are inserted between upper holder 4 and lower holder 5 of fixture 12 as shown in FIG. 4. Their resistance values are measured with a contact load applied as described earlier. The resultant measurements are given in FIG. 5.

Electrode 2 (ingredients A) of the comparison example has a volume resistivity of $4.25 \times 10^{-1}$ ohm.cm, which is greater than $4.0 \times 10^{-1}$ ohm.cm. The resistance value of its PTC element 1 cannot be reliably measured because it varies with contact load. On the other hand, electrode 2 (ingredients F) of this embodiment has a volume resistivity of $9.46 \times 10^{-2}$ ohm.cm. This is smaller than $4.0 \times 10^{-1}$ ohm.cm. The resistance value of electrode 2 (ingredients F) can be reliably monitored because it does not vary significantly with contact load.

In a third embodiment, PTC device 10 was produced in the same manner as the first embodiment, using electrodes 2 (ingredients B, D and G) of the first embodiment (see Table 1). An electrolytic nickel foil electrode 2, sample I of Table 3, is used for comparison. All of the PTC devices 10 were made with PTC element 1 consisting of the PTC composition shown in Table 4.

TABLE 4

| PTC Element Composition | | | |
|---|---|---|---|
| name of material | grade | manufacturer | weight ratio |
| high density polyethylene | Hi-Zex 1300J | Mitsui petrochemical industries | 82 |
| low density polyethylene | mirason 9* | Mitsui petrochemical industries | 18 |
| porous black | AsahiPB#400 | Asahi carbon | 37.5 |
| aluminium hydroxide | B703.ST | Nippon light metal | 50 |
| dicumylperoxide | percumyl D-40 | Nippon oil fats | 0.375 |

*Melting point: approximately 100–110° C.

Cross-linking treatment was then applied using 60 Mrad of gamma irradiation. Each of these samples are subjected to three thermal shock tests consisting of 20, 50 and 100 sequential cycles of thermal shock, respectively. Each cycle of thermal shock consists of application of 75° C. for 30 seconds and 125° C. for 30 seconds. The result of the test is shown in Table 5.

TABLE 5

| Thermal Shock Test Results | | | |
|---|---|---|---|
| | No. of cycles | | |
| sample No. | 20 cycles | 50 cycles | 100 cycles |
| B | No change | No change | No change |
| D | No change | No change | No change |
| G | No change | No change | No change |
| I | Wrinkles are produced, and spaces between electrode and PTC element appeared | Wrinkling worsened, resulting in peeling of electrode | Wrinkling and peeling further worsened |

In a fourth embodiment, PTC devices 10 were formed as for the third embodiment, and then cross-linked by means of 130 Mrad of gamma irradiation.

Swelling of the electrodes does not occur even though the greater irradiation causes a greater outgassing from PTC element 1. This is because electrodes 2 are themselves permeable to gas.

According to the present invention, electrode 2 is formed of a polymer with metal powder or a mixture of metal powder and carbonaceous conductive particles dispersed within. Because electrode 2 and PTC element 1 are both polymers they can be firmly bonded together. The probability of peeling during or after thermal shock, as occurs with metallic leaf electrodes 2, is eliminated. Swelling and peeling generally experienced with metallic electrodes 2 during cross-linking is also eliminated by the use of gas permeable polymer electrodes 2.

As the volume resistivity of electrode 2 is set at or less than $4.0 \times 10^{-1}$ ohm.cm, according to the present invention, it is possible for PTC device 10 to retain a stable resistance value as voltage decreases under a contact load of several hundred grams.

The electrode composition used in the current invention includes a polymer whose melting point is higher than that of the crystalline polymer of the PTC element composition used. This prevents electrode 2 from acting as a PTC element.

Polymers used for the composition of electrode 2 according to the present invention are derivatives produced by graft-polymerization of acrylic acid or maleic anhydride, as the monomers having functional groups, onto polyolefins or olefin-copolymers such as polypropylene, polyethylene or ethylene-vinyl acetate copolymer, for example, those sold under the brand names "Admer" (manufactured by Mitsui Petrochemical Industries) and "Duran." The crystalline polymer of PTC element 1 has a good compatibility with these polymers.

Nickel is the preferred metal powder used for the electrode composition since the resistance of nickel to oxidation minimizes changes in volume resistivity due to oxidization of the metal in the polymer mixture.

Because metal powder is blended into the electrode composition, PTC device 10 with this type of electrode 2 can be inserted directly into a holder equipped with metal terminals. Used as an overcurrent protection element, the resistance of PTC device 10 is stable during normal operation. PTC element 1 is connected through electrode 2 to a metal holder. Should a PTC anomaly of PTC device 10 occur (PTC device 10 reaches its tripping temperature as a result of an overcurrent condition), the PTC anomaly may be relieved by removing, and thereby cooling, the element without switching off the current. Because PTC device 10 self-recovers, when cooled, it returns to its nominal operating resistance value.

Furthermore, as PTC composition for electrical circuit protection consists of conductive particles such as, for example, carbon black or porous black, and of a polymer such as, for example, polyethylene, the composition bonds well with the polymer of the electrode. PTC device 10 also displays a strong affinity for a holder having a metal terminal because of the metal powder contained in electrode 2. By adding carbonaceous conductive particles to the ingredients of the electrode, the electrode is given an affinity for the carbon black and/or porous black contained in PTC element 1.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A PTC device comprising:

a PTC element formed of a PTC composition;

at least two electrodes formed of an electrode composition;

said electrode composition has a higher melting point than said PTC composition;

said electrode composition being a polymer containing metal particles dispersed therein; and said at least two electrodes being integrally affixed to said PTC element.

2. The PTC device of claim 1, wherein:

said PTC composition of said PTC element includes a crystalline polymer having carbonaceous conductive particles dispersed therein.

3. The PTC device of claim 1, wherein:

said polymer of said electrode composition having a mixture of metal powder and carbonaceous conductive particles dispersed therein.

4. The PTC device of claim 1, wherein a volume resistivity of said at least two electrodes is less than about $4.0\times10^{-1}$ ohm.cm.

5. The PTC device of claim 1, wherein said polymer of said electrode composition is a derivative graft-polymerized onto the backbone of polyolefin with a monomer having a functional group.

6. The PTC device of claim 1, wherein said metal particles of said electrode composition are nickel.

7. The PTC device of claim 1, wherein said PTC composition and said electrode composition are cross-linked.

8. The PTC device of claim 1, wherein said PTC element and electrode together form a self-recovery overcurrent protection element.

9. The PTC device of claim 1, wherein:

said PTC device being adapted for fitting into a holder; and said holder having at least two metal terminals.

10. A PTC device comprising:

a PTC element formed of a PTC composition;

at least two electrodes formed of an electrode composition;

said electrode composition has a higher melting point than said PTC composition;

said electrode composition being polymer dispersed metal particles;

said at least two electrodes being integrally formed with said PTC element;

said polymer of said electrode composition is a derivative graft-polymerized onto a backbone of polyolefin with a monomer having a functional group; and said PTC composition and said electrode composition are cross-linked.

11. A PTC device comprising:

a PTC element formed of a PTC composition;

at least two electrodes formed of an electrode composition;

said electrode composition being polymer dispersed metal particles;

said at least two electrodes being integrally formed with said PTC element;

said electrode composition has a higher melting point than said PTC composition; and a volume resistivity of said at least two electrodes is less than about $4.0\times10^{-1}$ ohm.cm.

12. The PTC device of claim 11, wherein said metal particles of said electrode composition are nickel.

13. The PTC device of claim 11, wherein said electrode composition, in addition to said metal particles, also contains carbonaceous conductive particles.

14. A method for making a PTC device comprising:

mixing together a carbon black and a first polymer to produce a PTC composition;

said carbon black and said first polymer being of a type providing a PTC characteristic;

forming said PTC composition into a PTC element;

cross-linking said first polymer in said PTC element;

mixing together a metal powder and a second polymer to produce an electrode composition;

said electrode composition having a higher melting point than said PTC composition; and molding said electrode composition to said PTC element.

15. A method according to claim 14, wherein the step of molding includes compression molding.

16. A method according to claim 14, wherein the step of molding is performed after the step of cross-linking.

* * * * *